US010304474B2

(12) United States Patent
Choo et al.

(10) Patent No.: US 10,304,474 B2
(45) Date of Patent: May 28, 2019

(54) SOUND QUALITY IMPROVING METHOD AND DEVICE, SOUND DECODING METHOD AND DEVICE, AND MULTIMEDIA DEVICE EMPLOYING SAME

(71) Applicant: SAMSUNG ELECTRONICS CO., LTD., Suwon-si (KR)

(72) Inventors: Ki-hyun Choo, Seoul (KR); Anton Viktorovich Porov, Saint-Petersburg (RU); Konstantin Sergeevich Osipov, Moscow (RU); Eun-mi Oh, Seoul (KR); Woo-jung Park, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/504,213

(22) PCT Filed: Aug. 17, 2015

(86) PCT No.: PCT/KR2015/008567
§ 371 (c)(1),
(2) Date: Feb. 15, 2017

(87) PCT Pub. No.: WO2016/024853
PCT Pub. Date: Feb. 18, 2016

(65) Prior Publication Data

US 2017/0236526 A1 Aug. 17, 2017

Related U.S. Application Data

(60) Provisional application No. 62/114,752, filed on Feb. 11, 2015.

(30) Foreign Application Priority Data

Aug. 15, 2014 (KR) ..... 10-2014-0106601

(51) Int. Cl.
*G10L 19/06* (2013.01)
*G10L 21/02* (2013.01)
(Continued)

(52) U.S. Cl.
CPC ..... *G10L 21/0205* (2013.01); *G10L 19/06* (2013.01); *G10L 21/02* (2013.01);
(Continued)

(58) Field of Classification Search
CPC ... G10L 19/0208; G10L 19/24; G10L 21/038; G10L 19/038; G10L 21/0208;
(Continued)

(56) References Cited

U.S. PATENT DOCUMENTS 6,574,593 B1 * 6/2003 Gao ..... G10L 19/00 704/222
6,978,236 B1 * 12/2005 Liljeryd ..... G10L 19/0208 704/200
(Continued)

FOREIGN PATENT DOCUMENTS

EP 2 657 933 A1 10/2013
KR 10-2007-0115637 A 12/2007
(Continued)

OTHER PUBLICATIONS

International Search Report (PCT/ISA/210) and Written Opinion (PCT/ISA/237) dated Nov. 27, 2015 issued by the International Searching Authority in counterpart International Application No. PCT/KR2015/008567.
(Continued)

*Primary Examiner* — Vijay B Chawan
(74) *Attorney, Agent, or Firm* — Sughrue Mion, PLLC

(57) ABSTRACT

A method of enhancing speech quality includes: generating a high-frequency signal by using a low-frequency signal in a time domain; combining the low-frequency signal with the
(Continued)

high-frequency signal; transforming the combined signal into a spectrum in a frequency domain; determining a class of a decoded speech signal; predicting an envelope from a low-frequency spectrum obtained in the transforming; and generating a final high-frequency spectrum by applying the predicted envelope to a high-frequency spectrum obtained in the transforming.

17 Claims, 13 Drawing Sheets

(51) Int. Cl.
*G10L 21/0364* (2013.01)
*G10L 21/0388* (2013.01)
*G10L 25/21* (2013.01)

(52) U.S. Cl.
CPC ..... *G10L 21/0364* (2013.01); *G10L 21/0388* (2013.01); *G10L 25/21* (2013.01)

(58) Field of Classification Search
CPC ..... G10L 21/0232; G10L 25/18; G10L 19/00; G10L 19/002; G10L 19/0204; G10L 19/022; G10L 19/025; G10L 19/035; G10L 19/04; G10L 19/06; G10L 19/167
USPC .... 704/219, 205, 225, 500–504, 223, 200.1, 704/200, 201, 206, 220, 222, 230, 275, 704/100.1
See application file for complete search history.

(56) References Cited

U.S. PATENT DOCUMENTS 8,078,474 B2 * 12/2011 Vos ..... G10L 19/0208 704/500
8,140,324 B2 * 3/2012 Vos ..... G10L 19/0208 704/200.1
8,260,611 B2 * 9/2012 Vos ..... G10L 19/0208 704/219
8,484,036 B2 * 7/2013 Vos ..... G10L 19/0208 704/219
8,655,649 B2 2/2014 Tsujino et al.
9,378,746 B2 6/2016 Choo
2005/0246164 A1 * 11/2005 Ojala ..... G10L 19/24 704/205
2007/0088542 A1 * 4/2007 Vos ..... G10L 19/0208 704/219
2007/0088558 A1 * 4/2007 Vos ..... G10L 19/0208 704/275
2007/0282599 A1 * 12/2007 Choo ..... G10L 21/038 704/205
2007/0296614 A1 12/2007 Lee et al.
2008/0126086 A1 * 5/2008 Vos ..... G10L 19/0208 704/225
2010/0063812 A1 * 3/2010 Gao ..... G10L 19/0204 704/230
2013/0030797 A1 1/2013 Gao
2013/0262122 A1 10/2013 Kim et al.

FOREIGN PATENT DOCUMENTS

KR 10-2007-0118167 A 12/2007
KR 10-1172326 B1 8/2012
KR 10-2013-0107257 A 10/2013
KR 10-1398189 B1 5/2014
WO 2004/064041 A1 7/2004
WO 2006/130221 A1 12/2006
WO 2013/141638 A1 9/2013

OTHER PUBLICATIONS

Communication dated Dec. 19, 2017, issued by the European Patent Office in counterpart European Application No. 15832602.5.

* cited by examiner

SOUND QUALITY IMPROVING METHOD AND DEVICE, SOUND DECODING METHOD AND DEVICE, AND MULTIMEDIA DEVICE EMPLOYING SAME

CROSS-REFERENCE TO RELATED APPLICATIONS

This application is a National stage entry of International Application No. PCT/KR2015/008567 filed on Aug. 17, 2015, which claims priority from U.S. Provisional Application No. 62/114,752 filed on Feb. 11, 2015 and Korean Patent Application No. 10-2014-0106601 filed on Aug. 15, 2014. The disclosures of each of the applications are herein incorporated by reference in their entirety.

TECHNICAL FIELD

The present disclosure relates to a method and apparatus for enhancing speech quality based on bandwidth extension, a speech decoding method and apparatus, and a multimedia device employing the same.

BACKGROUND ART

Various techniques for increasing speech call quality in a terminal such as a mobile phone or a tablet PC have been developed. For example, quality of a speech signal to be provided from a transmission end may be enhanced through pre-processing. Specifically, speech quality may be enhanced by detecting the characteristics of ambient noise to remove noise from the speech signal to be provided from the transmission end. As another example, speech quality may be enhanced by equalizing, in consideration of the characteristics of the ears of a terminal user, a speech signal restored by a reception end. As another example, enhanced speech quality of the restored speech signal may be provided by preparing a plurality of pre-sets in consideration of the general characteristics of the ears to the reception end and allowing the terminal user to select and use one thereof.

In addition, speech quality may be enhanced by extending a frequency bandwidth of a codec used for a call in the terminal, and particularly, a technique of extending a bandwidth without changing a configuration of a standardized codec has been required.

DETAILED DESCRIPTION OF THE INVENTION

Technical Problem

Provided are a method and apparatus for enhancing speech quality based on bandwidth extension.

Provided are a speech decoding method and apparatus for enhancing speech quality based on bandwidth extension.

Provided is a multimedia device employing a function of enhancing speech quality based on bandwidth extension.

Technical Solution

According to a first aspect of the present disclosure, a method of enhancing speech quality includes: generating a high-frequency signal by using a low-frequency signal in a time domain; combining the low-frequency signal with the high-frequency signal; transforming the combined signal into a spectrum in a frequency domain; determining a class of a decoded speech signal; predicting an envelope from a low-frequency spectrum obtained in the transforming; and generating a final high-frequency spectrum by applying the predicted envelope to a high-frequency spectrum obtained in the transforming.

The predicting of the envelope may include: predicting energy from the low-frequency spectrum of the speech signal; predicting a shape from the low-frequency spectrum of the speech signal; and calculating the envelope by using the predicted energy and the predicted shape.

The predicting of the energy may include applying a limiter to the predicted energy.

The predicting of the shape may include predicting each of a voiced shape and a unvoiced shape and predicting the shape from the voiced shape and the unvoiced shape based on the class and a voicing level.

The predicting of the shape may include: configuring an initial shape for the high-frequency spectrum from the low-frequency spectrum of the speech signal; and shape-rotating the initial shape.

The predicting of the shape may further include adjusting dynamics of the rotated initial shape.

The method may further include equalizing at least one of the low-frequency spectrum and the high-frequency spectrum.

The method may further include: equalizing at least one of the low-frequency spectrum and the high-frequency spectrum; inverse-transforming the equalized spectrum into a signal in the time domain; and post-processing the signal transformed into the time domain.

The equalizing and the inverse-transforming into the time domain may be performed on a sub-frame basis, and the post-processing may be performed on a sub-sub-frame basis.

The post-processing may include: calculating low-frequency energy and high-frequency energy; estimating a gain for matching the low-frequency energy and the high-frequency energy; and applying the estimated gain to a high-frequency time-domain signal.

The estimating of the gain may include limiting the estimated gain to a predetermined threshold if the estimated gain is greater than the threshold.

According to a second aspect of the present disclosure, a method of enhancing speech quality includes: determining a class of a decoded speech signal from a feature of the speech signal; generating a modified low-frequency spectrum by mixing a low-frequency spectrum and random noise based on the class; predicting an envelope of a high-frequency band from the low-frequency spectrum based on the class; applying the predicted envelope to a high-frequency spectrum generated from the modified low-frequency spectrum; and generating a bandwidth-extended speech signal by using the decoded speech signal and the envelope-applied high-frequency spectrum.

The generating of the modified low-frequency spectrum may include: determining a first weighting based on a prediction error; predicting a second weighting based on the first weighting and the class; whitening the low-frequency spectrum based on the second weighting; and generating the modified low-frequency spectrum by mixing the whitened low-frequency spectrum and random noise based on the second weight.

Each operation may be performed on a sub-frame basis.

The class may include a plurality of candidate classes based on low-frequency energy.

According to a third aspect of the present disclosure, an apparatus for enhancing speech quality includes a processor, wherein the processor determines a class of a decoded speech signal from a feature of the speech signal, generates a modified low-frequency spectrum by mixing a low-frequency spectrum and random noise based on the class, predicts an envelope of a high-frequency band from the low-frequency spectrum based on the class, applies the predicted envelope to a high-frequency spectrum generated from the modified low-frequency spectrum, and generates a bandwidth-extended speech signal by using the decoded speech signal and the envelope-applied high-frequency spectrum.

According to a fourth aspect of the present disclosure, a speech decoding apparatus includes: a speech decoder configured to decode an encoded bitstream; and a post-processor configured to generate bandwidth-extended wideband speech data from decoded speech data, wherein the post-processor determines a class of a decoded speech signal from a feature of the speech signal, generates a modified low-frequency spectrum by mixing a low-frequency spectrum and random noise based on the class, predicts an envelope of a high-frequency band from the low-frequency spectrum based on the class, applies the predicted envelope to a high-frequency spectrum generated from the modified low-frequency spectrum, and generates a bandwidth-extended speech signal by using the decoded speech signal and the envelope-applied high-frequency spectrum.

According to a fourth aspect of the present disclosure, a multimedia device includes: a communication unit configured to receive an encoded speech packet; a speech decoder configured to decode the received speech packet; and a post-processor configured to generate bandwidth-extended wideband speech data from the decoded speech data, wherein the post-processor determines a class of a decoded speech signal from a feature of the speech signal, generates a modified low-frequency spectrum by mixing a low-frequency spectrum and random noise based on the class, predicts an envelope of a high-frequency band from the low-frequency spectrum based on the class, applies the predicted envelope to a high-frequency spectrum generated from the modified low-frequency spectrum, and generates a bandwidth-extended speech signal by using the decoded speech signal and the envelope-applied high-frequency spectrum.

Advantageous Effects of the Invention

A decoding end may obtain a bandwidth-extended wideband signal from a narrow-band speech signal without changing a configuration of a standardized codec, and thus a restored signal of which speech quality has been enhanced may be generated.

MODE OF THE INVENTION

Figure 1:
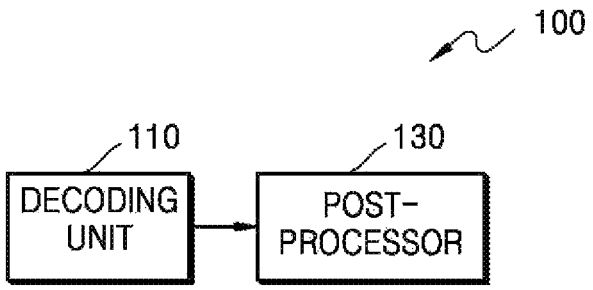
FIG. 1 is a block diagram of a speech decoding apparatus according to an exemplary embodiment.

Hereinafter, embodiments will be described in detail with reference to the accompanying drawings so that those of ordinary skill in the art to which the present disclosure belongs may easily realize the embodiments. However, the embodiments may be embodied in many different forms and should not be construed as being limited to the embodiments set forth herein. In addition, parts irrelevant to the description are omitted to clearly describe the embodiments, and like reference numerals denote like elements throughout the present disclosure.

Throughout the present disclosure, when it is described that a certain part is "connected" to another part, it should be understood that the certain part may be connected to another part "electrically or physically" via another part in the middle. In addition, when a certain part "includes" a certain component, this indicates that the part may further include another component instead of excluding another component unless there is different disclosure.

Hereinafter, the embodiments are described in detail with reference to the accompanying drawings.

FIG. 1 is a block diagram of a speech decoding apparatus 100 according to an exemplary embodiment. Although "speech" is used herein for convenience of description, the speech may indicate a sound including audio and/or voice.

The apparatus 100 shown in FIG. 1 may include a decoding unit 110 and a post-processor 130. The decoding unit 110 and the post-processor 130 may be implemented by separate processors or integrated into one processor.

Referring to FIG. 1, the decoding unit 110 may decode a received speech communication packet received through an antenna (not shown). The decoding unit 110 may decode a bitstream stored in the apparatus 100. The decoding unit 110 may provide decoded speech data to the post-processor 130. The decoding unit 110 may use a standardized codec but is not limited thereto. According to an embodiment, the decoding unit 110 may perform decoding by using an adaptive multi-rate (AMR) codec that is a narrowband codec.

The post-processor 130 may perform post-processing for speech quality enhancement with respect to the decoded speech data provided from the decoding unit 110. According to an embodiment, the post-processor 130 may include a wideband bandwidth extension module. The post-processor 130 may increase a natural property and a sense of realism of speech by extending a bandwidth of the speech data, which has been decoded by the decoding unit 110 by using the narrowband codec, into a wideband. The bandwidth extension processing applied to the post-processor 130 may be largely divided into a guided scheme of providing additional information for the bandwidth extension processing from a transmission end and a non-guided scheme, i.e., a blind scheme, of not providing the additional information for the bandwidth extension processing from the transmission end. The guided scheme may require a change in a configuration of a codec for a call in the transmission end. However, the blind scheme may enhance speech quality by changing a post-processing portion at a reception end without the configuration change of the codec for a call in the transmission end.

Figure 2:
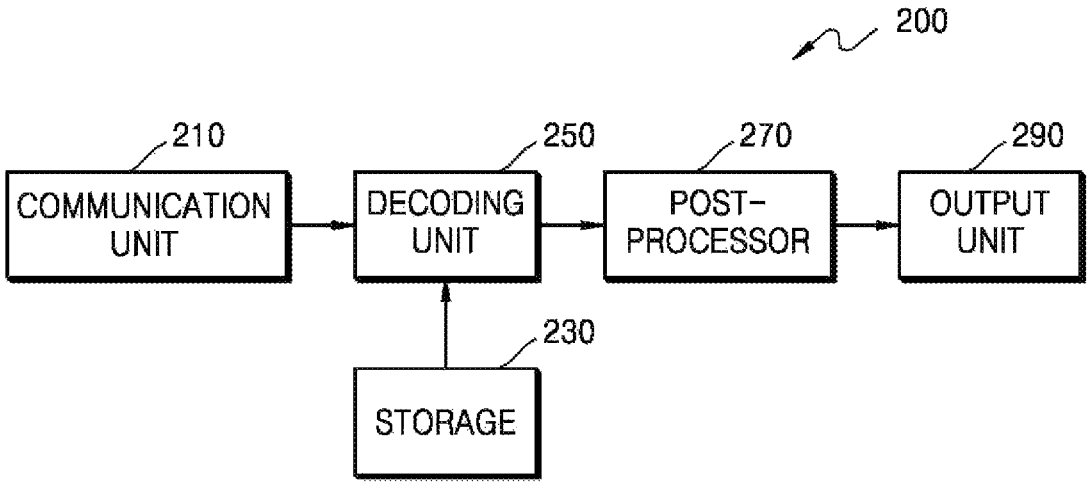
FIG. 2 is a block diagram illustrating some components of a device having a speech quality enhancement function, according to an exemplary embodiment.

FIG. 2 is a block diagram illustrating some components of a device 200 having a speech quality enhancement function, according to an exemplary embodiment. The device 200 of FIG. 2 may correspond to various multimedia devices such as mobile phones or tablet PCs.

The device 200 shown in FIG. 2 may include a communication unit 210, a storage 230, a decoding unit 250, a post-processor 270, and an output unit 290. The decoding unit 250 and the post-processor 270 may be implemented by separate processors or integrated into one processor. Although not shown, the device 200 may include a user interface.

Referring to FIG. 2, the communication unit 210 may receive a speech communication packet from the outside through a transmission and reception antenna. The storage 230 may be connected to an external device to receive, from the external device, and store an encoded bitstream.

The decoding unit 250 may decode the received speech communication call packet or the encoded bitstream. The decoding unit 250 may provide decoded speech data to the post-processor 270. The decoding unit 250 may use a standardized codec but is not limited thereto. According to an embodiment, the decoding unit 250 may include a narrowband codec, and an example of the narrowband codec is an AMR codec.

The post-processor 270 may perform post-processing for speech quality enhancement with respect to the decoded speech data provided from the decoding unit 250. According to an embodiment, the post-processor 270 may include a wideband bandwidth extension module. The post-processor 270 may increase a natural property and a sense of realism of speech by extending a bandwidth of the speech data, which has been decoded by the decoding unit 250 by using the narrowband codec, into a wideband. The bandwidth extension processing performed by the post-processor 270 may be largely divided into the guided scheme of providing additional information for the bandwidth extension processing from a transmission end and the non-guided scheme, i.e., the blind scheme, of not providing the additional information for the bandwidth extension processing from the transmission end. The guided scheme may require a change in a configuration of a codec for a call in the transmission end. However, the blind scheme may enhance speech quality by changing post-processing at a reception end without the configuration change of the codec for a call in the transmission end. The post-processor 270 may transform the bandwidth-extended speech data into an analog signal.

The output unit 290 may output the analog signal provided from the post-processor 270. The output unit 290 may be replaced with a receiver, a speaker, earphones, or headphones. The output unit 290 may be connected to the post-processor 270 in a wired or wireless manner.

Figure 3:
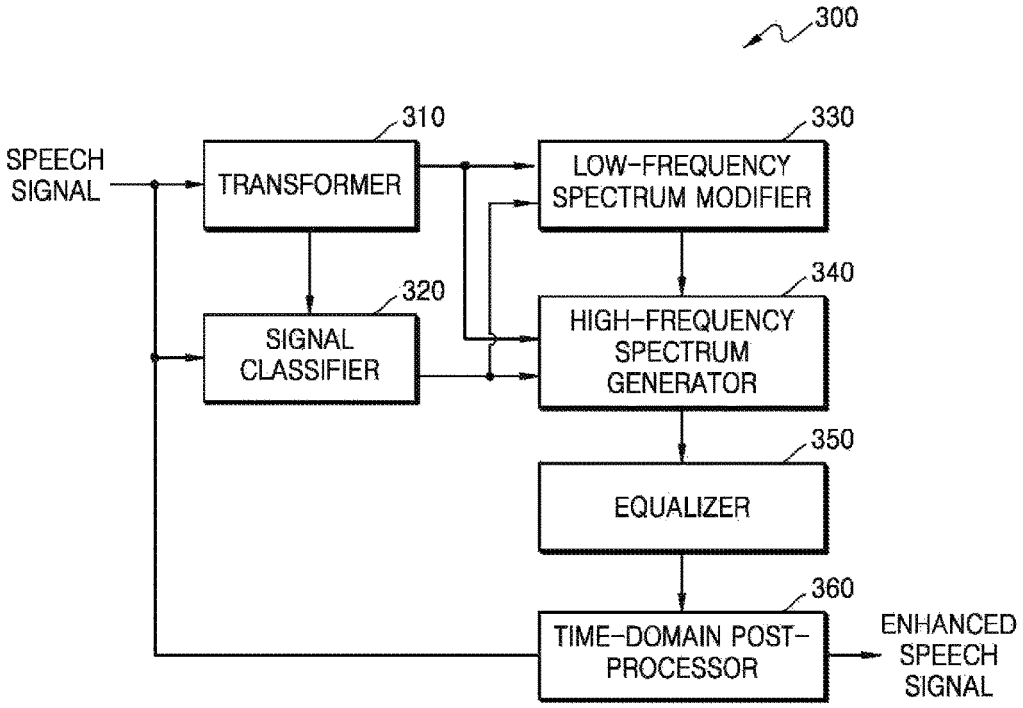
FIG. 3 is a block diagram of an apparatus for enhancing speech quality, according to an exemplary embodiment.

FIG. 3 is a block diagram of an apparatus 300 for enhancing speech quality, according to an exemplary embodiment, and may correspond to the post-processor 130 or 270 of FIG. 1 or 2.

The apparatus 300 shown in FIG. 3 may include a transformer 310, a signal classifier 320, a low-frequency spectrum modifier 330, a high-frequency spectrum generator 340, an equalizer 350, and a time-domain post-processor 360. The components may be implemented by respective processors or integrated into at least one processor. Herein, the equalizer 350 and the time-domain post-processor 360 may be optionally included.

Referring to FIG. 3, the transformer 310 may transform a decoded narrowband speech signal, e.g., a core signal, into a frequency-domain signal. The transformed frequency-domain signal may be a low-frequency spectrum. The transformed frequency-domain signal may be referred to as a core spectrum.

The signal classifier 320 may determine a type or class by classifying the speech signal based on a feature of the speech signal. As the feature of the speech signal, any one of or both a time-domain feature and a frequency-domain feature may be used. The time-domain feature and the frequency-domain feature may include a plurality of well-known parameters.

The low-frequency spectrum modifier 330 may modify the frequency-domain signal, i.e., a low-frequency spectrum or a low-frequency excitation spectrum, from the transformer 310 based on the class of the speech signal.

The high-frequency spectrum generator 340 may generate a high-frequency spectrum by obtaining a high-frequency excitation spectrum from the modified low-frequency spectrum or low-frequency excitation spectrum, predicting an envelope from the low-frequency spectrum based on the class of the speech signal, and applying the predicted envelope to the high-frequency excitation spectrum.

The equalizer 350 may equalize the generated high-frequency spectrum.

The time-domain post-processor 360 may transform the equalized high-frequency spectrum into a high-frequency time-domain signal, generate a wideband speech signal, i.e., an enhanced speech signal, by combining the high-frequency time-domain signal and a low-frequency time-domain signal, and perform post-processing such as filtering.

Figure 4:
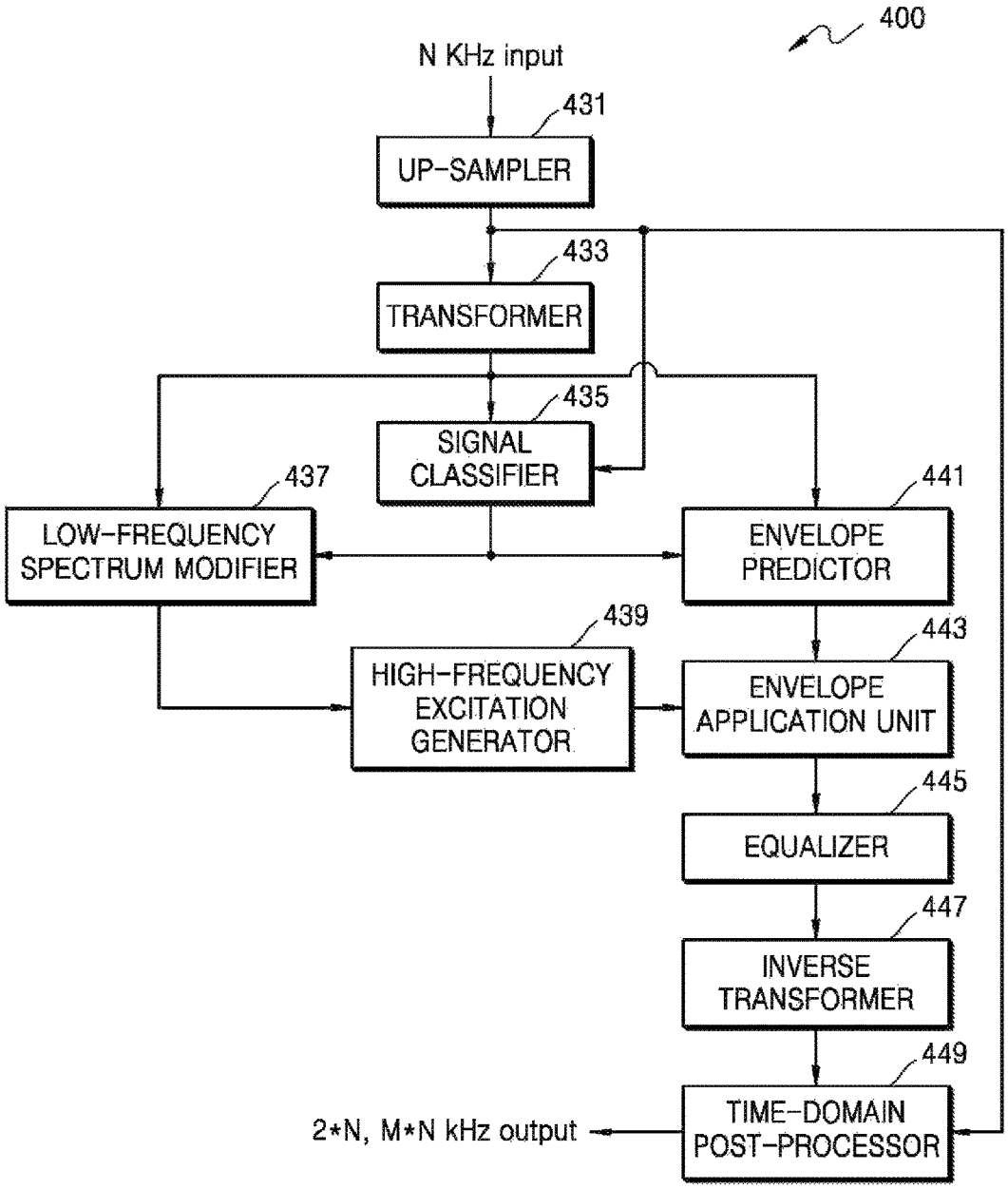
FIG. 4 is a block diagram of an apparatus for enhancing speech quality, according to another exemplary embodiment.

FIG. 4 is a block diagram of an apparatus 400 for enhancing speech quality, according to another exemplary embodiment, and may correspond to the post-processor 130 or 270 of FIG. 1 or 2.

The apparatus 400 shown in FIG. 4 may include an up-sampler 431, a transformer 433, a signal classifier 435, a low-frequency spectrum modifier 437, a high-frequency excitation generator 439, an envelope predictor 441, an envelope application unit 443, an equalizer 445, an inverse transformer 447, and a time-domain post-processor 449. Herein, the high-frequency excitation generator 439, the envelope predictor 441, and the envelope application unit 443 may correspond to the high-frequency spectrum generator 340 of FIG. 3. The components may be implemented by respective processors or integrated into at least one processor.

Referring to FIG. 4, the up-sampler 431 may up-sample a decoded signal of an N-KHz sampling rate. For example, a signal of a 16-KHz sampling rate may be generated from a signal of an 8-KHz sampling rate through up-sampling. The up-sampler 431 may be optionally included. When an up-sampled signal is provided from the decoding unit 110 or 250 of FIG. 1 or 2, the up-sampled signal may be directly provided to the transformer 433 without passing through the up-sampler 431. The decoded signal of the N-KHz sampling rate may be a narrowband time-domain signal.

The transformer 433 may generate a frequency-domain signal, i.e., a low-frequency spectrum, by transforming the up-sampled signal. The transform may be modified discrete cosine transform (MDCT), fast Fourier transform (FFT), modified discrete cosine transform and modified discrete sine transform (MDCT+MDST), quadrature mirror filter (QMF), or the like but is not limited thereto. Herein, the low-frequency spectrum may indicate a low-band or core spectrum.

The signal classifier 435 may extract a feature of a signal by receiving the up-sampled signal and the frequency-domain signal and determine a class, i.e., a type, of the speech signal based on the extracted feature. Since the up-sampled signal is a time-domain signal, the signal classifier 435 may extract a feature of each of the time-domain signal and the frequency-domain signal. Class information generated by the signal classifier 435 may be provided to the low-frequency spectrum modifier 437 and the envelope predictor 441.

The low-frequency spectrum modifier 437 may receive the frequency-domain signal provided from the transformer 433 and modify the received frequency-domain signal into a low-frequency spectrum, which is a signal suitable for bandwidth extension processing, based on the class information provided from the signal classifier 435. The low-frequency spectrum modifier 437 may provide the modified low-frequency spectrum to the high-frequency excitation generator 439. Herein, a low-frequency excitation spectrum may be used instead of the low-frequency spectrum.

The high-frequency excitation generator 439 may generate a high-frequency excitation spectrum by using the modified low-frequency spectrum. Specifically, the modified low-frequency spectrum may be obtained from an original low-frequency spectrum, and the high-frequency excitation spectrum may be a spectrum simulated based on the modified low-frequency spectrum. Herein, the high-frequency excitation spectrum may indicate a high-band excitation spectrum.

The envelope predictor 441 may receive the frequency-domain signal provided from the transformer 433 and the class information provided from the signal classifier 435 and predict an envelope.

The envelope application unit 443 may generate a high-frequency spectrum by applying the envelope provided from the envelope predictor 441 to the high-frequency excitation spectrum provided from the high-frequency excitation generator 439.

The equalizer 445 may receive the high-frequency spectrum provided from the envelope application unit 443 and equalize a high-frequency band. Alternatively, the low-frequency spectrum from the transformer 433 may also be input to the equalizer 445 through various routes. In this case, the equalizer 445 may selectively equalize a low-frequency band and the high-frequency band or equalize a full band. The equalizing may use various well-known methods. For example, adaptive equalizing for each band may be performed.

The inverse transformer 447 may generate a time-domain signal by inverse-transforming the high-frequency spectrum provided from the equalizer 445. Alternatively, the equalized low-frequency spectrum from the transformer 433 may also be provided to the inverse transformer 447. In this case, the inverse transformer 447 may generate a low-frequency time-domain signal and a high-frequency time-domain signal by individually inverse-transforming the low-frequency spectrum and the high-frequency spectrum. According to an embodiment, as the low-frequency time-domain signal, the signal of the up-sampler 431 may be used as it is, and the inverse transformer 447 may generate only the high-frequency time-domain signal. In this case, since the low-frequency time-domain signal is the same as an original speech signal, the low-frequency time-domain signal may be processed without the occurrence of a delay.

The time-domain post-processor 449 may suppress noises by post-processing the low-frequency time-domain signal and the high-frequency time-domain signal provided from the inverse transformer 447 and generate a wideband time-domain signal by synthesizing the post-processed low-frequency time-domain signal and high-frequency time-domain signal. The signal generated by the time-domain post-processor 449 may be a signal of a 2*N- or M*N-KHz sampling rate (M is 2 or greater). The time-domain post-processor 449 may be optionally included. According to an embodiment, both the low-frequency time-domain signal and the high-frequency time-domain signal may be equalized signals. According to another embodiment, the low-frequency time-domain signal may be an original narrowband signal, and the high-frequency time-domain signal may be an equalized signal.

According to an embodiment, even when no information about a high-frequency band is provided from an AMR bitstream, a high-frequency spectrum may be generated through prediction from a narrowband spectrum.

Figure 5:
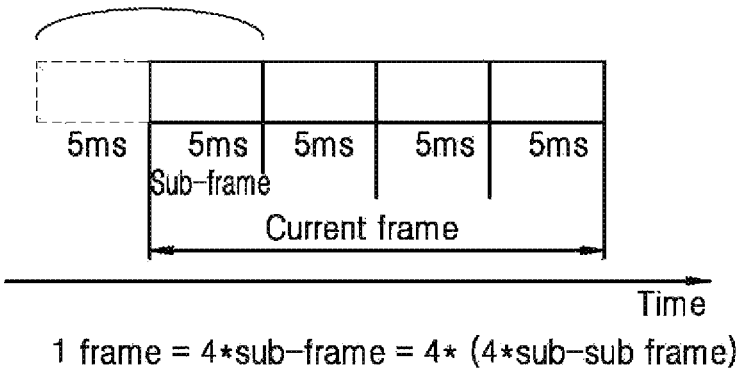
FIG. 5 illustrates framing for bandwidth extension processing.

FIG. 5 illustrates framing for bandwidth extension processing.

Referring to FIG. 5, one frame may include, for example, four sub-frames. When the one frame is configured by 20 ms by which a common speech codec operates, one sub-frame may be configured by 5 ms. A block represented as a dashed line may indicate a last sub-frame of a previous frame, i.e., a last end frame, and four blocks represented as a solid line may indicate four sub-frames of a current frame. During transform, the last sub-frame of the previous frame and a first sub-frame of the current frame may be window-processed. The window-processed signal may be used for bandwidth extension processing. The framing of FIG. 5 may be applied when transform is performed by using MDCT. Alternatively, for transform according to another scheme, other framing may be applied. Herein, each sub-frame may be used as a basic unit for bandwidth extension processing. Specifically, with reference to FIG. 4, the up-sampler 431 to the time-domain post-processor 449 may operate on a sub-frame basis. That is, bandwidth extension processing on one frame may be completed by repeating an operation four times. Alternatively, the time-domain post-processor 449 may post-process one sub-frame on a sub-sub-frame basis. One sub-frame may include four sub-sub-frames. In this case, one frame may include 16 sub-sub-frames. The number of sub-frames constituting a frame and the number of sub-sub-frames constituting a sub-frame may vary.

Figure 6:
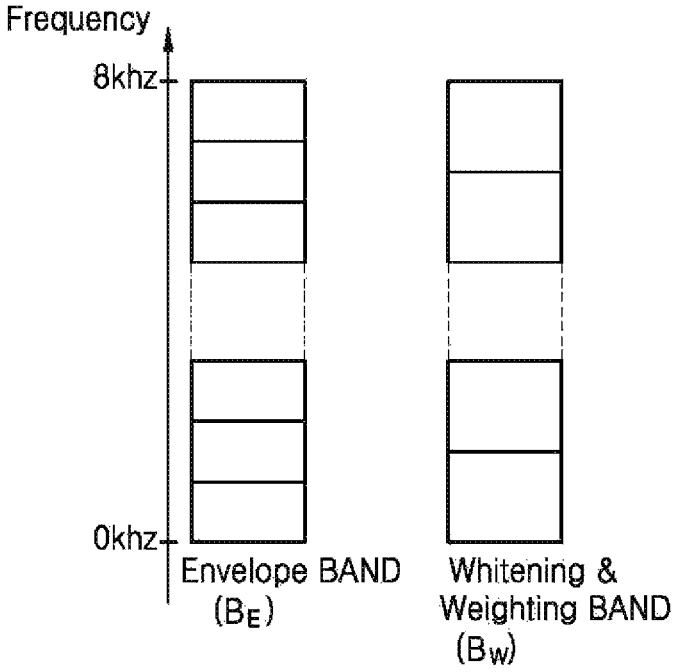
FIG. 6 illustrates band configurations for bandwidth extension processing.

FIG. 6 illustrates band configurations for bandwidth extension processing and assumes wideband bandwidth extension processing. Specifically, FIG. 6 shows an example in which a signal of the 16-KHz sampling rate is obtained by up-sampling a signal of the 8-KHz sampling rate, and a 4- to 8-KHz spectrum is generated by using the signal of the 16-KHz sampling rate.

Referring to FIG. 6, an envelope band $B_E$ includes 20 bands in the entire frequency band, and a whitening and weighting band $B_W$ includes eight bands. In this case, each band may be uniformly or non-uniformly configured according to frequency bands.

Figure 7:
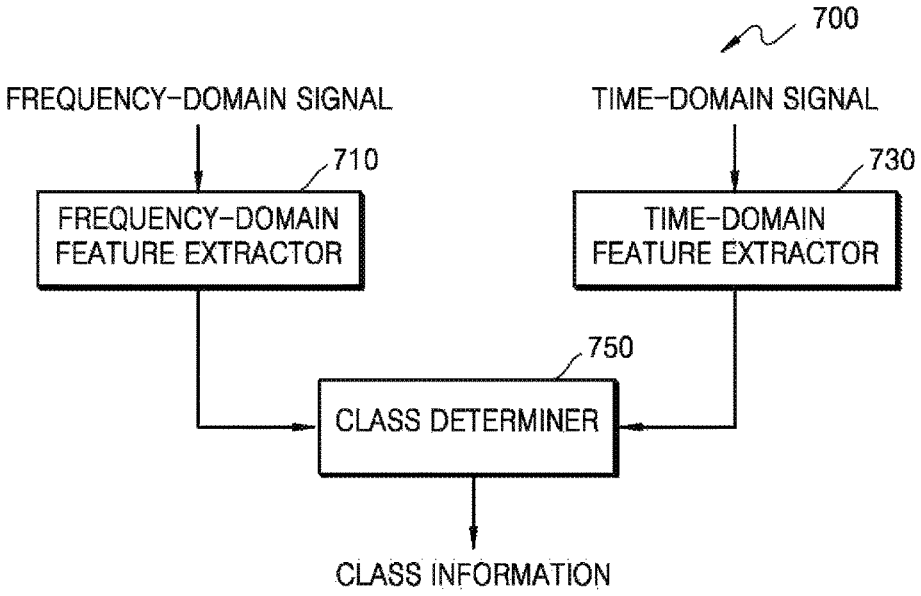
FIG. 7 is a block diagram of a signal classification module according to an exemplary embodiment.

FIG. 7 is a block diagram of a signal classification module 700 according to an exemplary embodiment and may correspond to the signal classifier 435 of FIG. 4.

The signal classification module 700 shown in FIG. 7 may include a frequency-domain feature extractor 710, a time-domain feature extractor 730, and a class determiner 750. The components may be implemented by respective processors or integrated into at least one processor.

Referring to FIG. 7, the frequency-domain feature extractor 710 may extract a frequency-domain feature from the frequency-domain signal, i.e., a spectrum, provided from the transformer (433 of FIG. 4).

The time-domain feature extractor 730 may extract a time-domain feature from the time-domain signal provided from the up-sampler (431 of FIG. 4).

The class determiner 750 may generate class information by determining a class of a speech signal, e.g., a class of a current sub-frame, from the frequency-domain feature and the time-domain feature. The class information may include a single class or a plurality of candidate classes. In addition, the class determiner 750 may obtain a voicing level from the class determined with respect to the current sub-frame. The determined class may be a class having the highest probability value. According to an embodiment, a voicing level is mapped for each class, and a voicing level corresponding to the determined class may be obtained. Alternatively, a final voicing level of the current sub-frame may be obtained by using the voicing level of the current sub-frame and a voicing level of at least one previous sub-frame.

An operation of each component is described in more detail as follows.

Examples of the feature extracted from the frequency-domain feature extractor 710 may be centroid C and energy quotient E but are not limited thereto.

The centroid C may be defined by Equation 1.

$$C = \frac{\sum_i (i+1)\sqrt{x_i x_i^*}}{\sum_i \sqrt{x_i x_i^*}} \tag{1}$$

where x denotes a spectral coefficient.

The energy quotient E may be defined by a ratio of short-term energy $E_{Short}$ to long-term energy $E_{Long}$ by using Equation 2.

$$E = \frac{E_{Short}}{E_{Long}} \tag{2}$$

Herein, both the short-term energy and the long-term energy may be determined based on a history up to a previous sub-frame. In this case, a short term and a long term are discriminated according to a level of a contributory portion of the current sub-frame with respect to energy, and for example, compared with the short term, the long term may be defined by a method of multiplying an average of energy up to the previous sub-frame by a higher rate. Specifically, the long term is designed such that energy of the current sub-frame is reflected less, and the short term is designed such that the energy of the current sub-frame is reflected more when compared with the long term.

An example of the feature extracted from the time-domain feature extractor 730 may be gradient index G but is not limited thereto.

The gradient index G may be defined by Equation 3

$$G = \frac{\sum_i |t_i - t_{i-1}||s_i - s_{i-1}|}{2\sqrt{\sum_i t_i^2}}, \tag{3}$$

$$s_i = \text{sign}(t_i - t_{i-1}),\ \text{sign}(z) = \begin{cases} +1, & z \geq 0 \\ -1, & \text{otherwise} \end{cases}$$

where t denotes a time-domain signal and sign denotes +1 when the signal is 0 or greater and −1 when the signal is less than 0.

The class determiner 750 may determine a class of the speech signal from at least one frequency-domain feature and at least one time-domain feature. According to an embodiment, a Gaussian mixture model (GMM) that is well known based on low-frequency energy may be used to determine the class. The class determiner 750 may decide one class for each sub-frame or derive a plurality of candidate classes based on soft decision. According to an embodiment, when the low-frequency energy is based and is a specific value or less, one class is decided, and when the low-frequency energy is the specific value or more, a plurality of candidate classes may be derived. Herein, the low-frequency energy may indicate narrowband energy or energy of a specific frequency band or less. The plurality of candidate classes may include, for example, a class having the highest probability value and classes adjacent to the class having the highest probability value. When the plurality of candidate classes are selected, each class has a probability value, and thus a prediction value is calculated in consideration of a probability value. A voicing level mapped to the single class or the class having the highest probability value may be used. Energy prediction may be performed based on the candidate classes and probability values of the candidate classes. Prediction may be performed for each candidate class, and a final prediction value may be determined by multiplying a probability value by a prediction value obtained as a result of the prediction.

Figure 8:
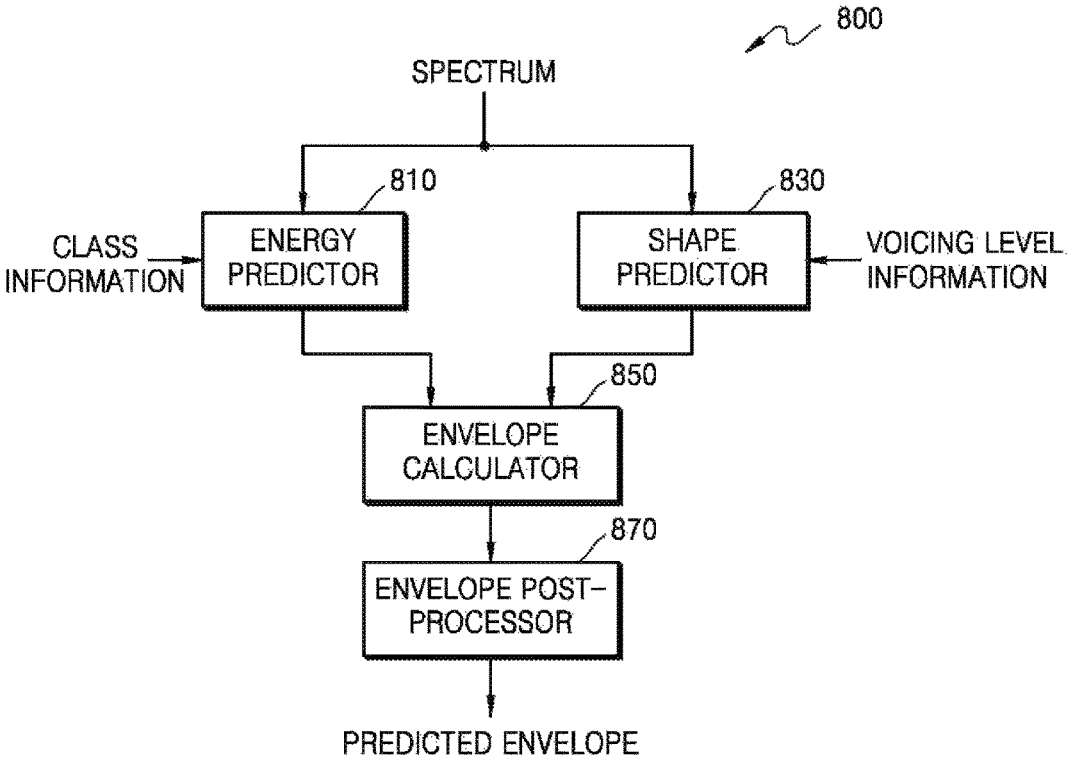
FIG. 8 is a block diagram of an envelope prediction module according to an exemplary embodiment.

FIG. 8 is a block diagram of an envelope prediction module 800 according to an exemplary embodiment and may correspond to the envelope predictor 441 of FIG. 4.

The envelope prediction module 800 shown in FIG. 8 may include an energy predictor 810, a shape predictor 830, an envelope calculator 850, and an envelope post-processor 870. The components may be implemented by respective processors or integrated into at least one processor.

Referring to FIG. 8, the energy predictor 810 may predict energy of a high-frequency spectrum from a frequency-domain signal, i.e., a low-frequency spectrum, based on class information. An embodiment of the energy predictor 810 will be described in more detail with reference to FIG. 9.

The shape predictor 830 may predict a shape of the high-frequency spectrum from the frequency-domain signal, i.e., the low-frequency spectrum, based on the class information and voicing level information. The shape predictor 830 may predict a shape with respect to each of a voiced speech and a unvoiced speech. An embodiment of the shape predictor 830 will be described in more detail with reference to FIG. 10.

Figure 9:
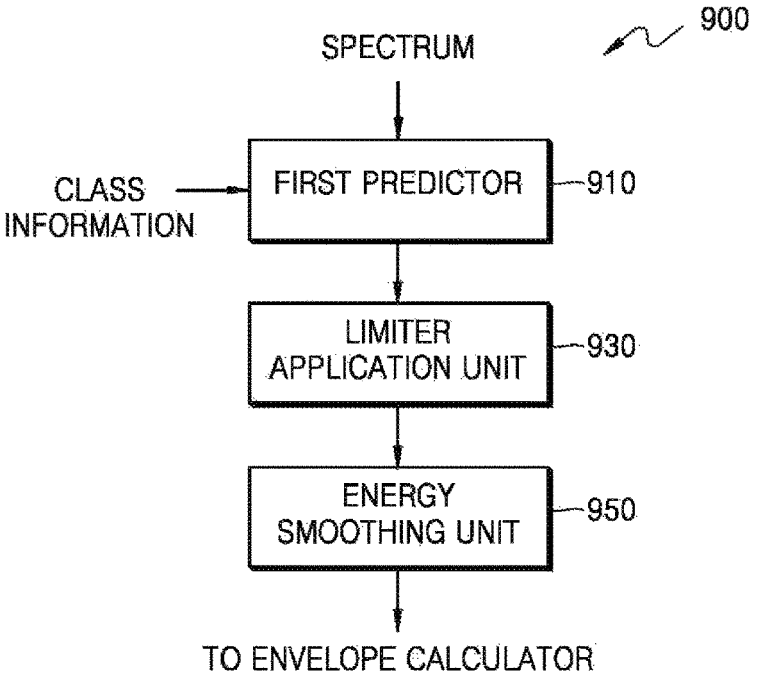
FIG. 9 is a detailed block diagram of an energy predictor shown in FIG. 8.

FIG. 9 is a detailed block diagram of the energy predictor 810 shown in FIG. 8.

An energy predictor 900 shown in FIG. 9 may include a first predictor 910, a limiter application unit 930, and an energy smoothing unit 950.

Referring to FIG. 9, the first predictor 910 may predict energy of a high-frequency spectrum from a frequency-domain signal, i.e., a low-frequency spectrum, based on class information. The energy $\tilde{E}$ predicted by the first predictor 710 may be defined by Equation 4.

$$\tilde{E}=\Sigma\tilde{E}_j*\text{prob}_j \tag{4}$$

Specifically, final predicted energy $\tilde{E}$ may be obtained by predicting $\tilde{E}_j$ for each of a plurality of candidate classes, multiplying $\tilde{E}_j$ by a determined probability value $\text{prob}_j$, and then summing the multiplication result for the plurality of candidate classes. To this end, $\tilde{E}_j$ may be predicted by obtaining a basis including a codebook set for each class, a low-frequency envelope extracted from a current sub-frame, and a standard deviation of the low-frequency envelope and multiplying the obtained basis by a matrix stored for each class.

The low-frequency envelope Env(i) may be defined by Equation 5. That is, energy may be predicted by using log energy for each sub-band of a low frequency and a standard deviation.

$$Env(i) = \frac{1}{B_E(i)}\log10\left(\sum_{j\in band(i)} x_j * x_j\right) \tag{5}$$

$\tilde{E}$ may be obtained by Equation 4 using the obtained $\tilde{E}_j$.

The limiter application unit 730 may apply a limiter to the predicted energy $\tilde{E}$ provided from the first predictor 710 to suppress noises which may occur when a value of $\tilde{E}$ is too great. In this case, as energy acting as the limiter, a linear envelope defined by Equation 6 may be used instead of a log-domain envelope.

$$Env_l(i) = \frac{1}{B_E(i)}\sum_{j\in band(i)} |x_j| \tag{6}$$

A basis may be configured by obtaining a plurality of centroids C defined by Equation 7 from the linear envelope obtained from Equation 6.

$$C_i = \frac{C_{LB}\text{mL} + C_{max}\text{mL}_i}{\text{mL} + \text{mL}_i} \tag{7}$$

where $C_{LB}$ denotes a centroid value calculated by the frequency-domain feature extractor 710 of FIG. 7, mL denotes an average value of low-band linear envelopes, $\text{mL}_i$ denotes a low-band linear envelope value, and $C_{max}$ denotes a maximum centroid value and is a constant. The basis may be obtained by using the $C_i$ values and a standard deviation, and a centroid prediction value may be obtained through a plurality of predictors configured to perform prediction by using a portion of the basis. Minimum and maximum centroids may be obtained from among centroid prediction values, an average value $\tilde{C}$ of the minimum and maximum values may be transformed to energy by using Equation 8 below, and the transformed energy value may be used as the limiter. A method of obtaining a plurality of centroid prediction values is similar to the above-described method of predicting $\tilde{E}_j$ and may be performed by setting a codebook based on class information and multiplying the codebook by the obtained basis.

$$E_{lim} = \frac{C - \tilde{C}}{\tilde{C} - C\max} * \text{mL} \tag{8}$$

The energy smoothing unit 950 performs energy-smoothing by reflecting a plurality of energy values predicted in a previous sub-frame to the predicted energy provided from the limiter application unit 930. As an example of the smoothing, a predicted energy difference between the previous sub-frame and the current sub-frame may be restricted within a predetermined range. The energy smoothing unit 950 may be optionally included.

Figure 10:
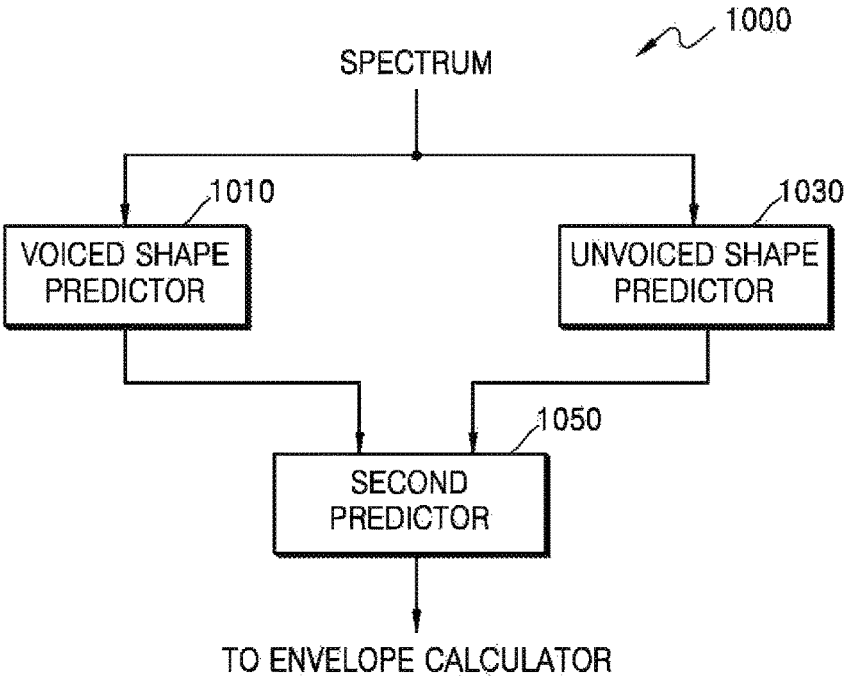
FIG. 10 is a detailed block diagram of a shape predictor shown in FIG. 8.

FIG. 10 is a detailed block diagram of the shape predictor 830 shown in FIG. 8.

A shape predictor 830 shown in FIG. 10 may include a voiced shape predictor 1010, a unvoiced shape predictor 1030, and a second predictor 1050.

Referring to FIG. 10, the voiced shape predictor 1010 may predict a voiced shape of a high-frequency band by using a low-frequency linear envelope, i.e., a low-frequency shape.

The unvoiced shape predictor 1030 may predict a unvoiced shape of the high-frequency band by using the low-frequency linear envelope, i.e., the low-frequency shape, and adjust the unvoiced shape according to a shape comparison result between a low-frequency part and a high-frequency part in the high-frequency band.

The second predictor 1050 may predict a shape of a high-frequency spectrum by mixing the voiced shape and the unvoiced shape at a ratio based on a voicing level.

Referring back to FIG. 8, the envelope calculator 850 may receive the energy $\tilde{E}$ predicted by the energy predictor 810 and the shape Sha(i) predicted by the shape predictor 830 and obtain an envelope Env(i) of the high-frequency spectrum. The envelope of the high-frequency spectrum may be obtained by Equation 9.

$$Env(i) = \frac{\tilde{E}}{\sum Sha(i)} * Sha(i) \tag{9}$$

The envelope post-processor 870 may post-process the envelope provided from the envelope calculator 850. As an example of the post-processing, an envelope of a start portion of a high frequency may be adjusted by considering an envelope of an end portion of a low frequency at a boundary between the low frequency and the high frequency. The envelope post-processor 870 may be optionally included.

Figure 11:
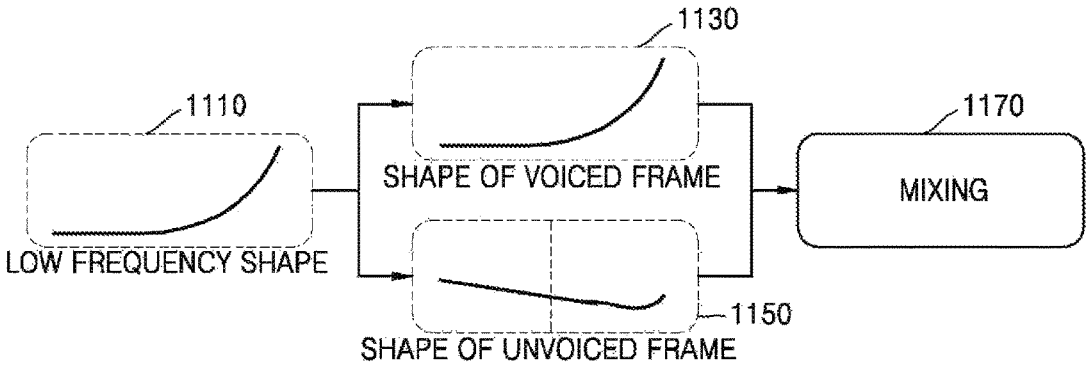
FIG. 11 illustrates a method of generating a unvoiced shape and a voiced shape.

FIG. 11 illustrates a method of generating a unvoiced shape and a voiced shape in a high-frequency band.

Referring to FIG. 11, in a voiced shape generation step 1130, a voiced shape 1130 may be generated by transposing a low-frequency linear envelope, i.e., a low-frequency shape obtained in a low-frequency shape generation step 1110, to the high-frequency band.

In a unvoiced shape generation step 1150, a unvoiced shape is basically generated through transposing, and if a shape of a high-frequency part is greater than a shape of a low-frequency part through comparison therebetween in the high-frequency band, the shape of the high-frequency part may be reduced. As a result, the possibility that noise occurs due to a relative increase in the shape of the high-frequency part in the high-frequency band may be reduced.

In a mixing step 1170, a predicted shape of a high-frequency spectrum may be generated by mixing the generated voiced shape and the generated unvoiced shape based on a voicing level. Herein, a mixing ratio may be determined by using the voicing level. The predicted shape may be provided to the envelope calculator 850 of FIG. 8.

Figure 12:
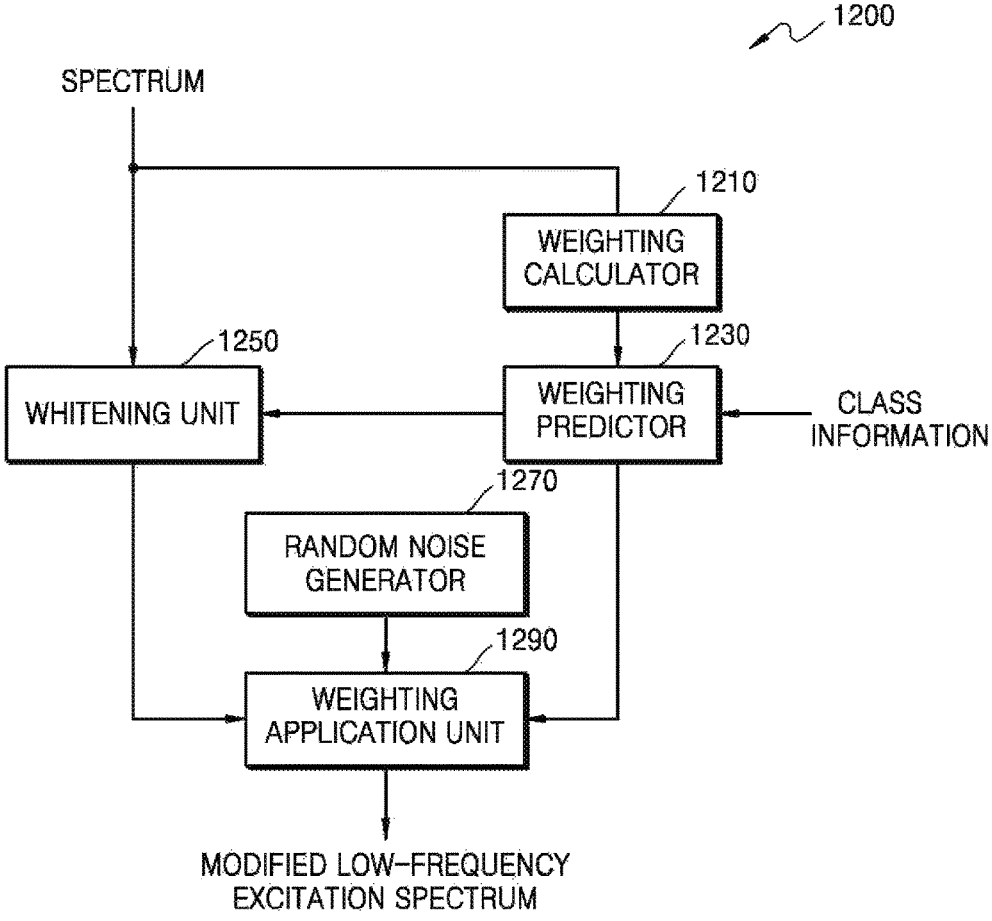
FIG. 12 is a block diagram of a low-frequency excitation modification module according to an exemplary embodiment.

FIG. 12 is a block diagram of a low-frequency spectrum modification module 1200 according to an exemplary embodiment and may correspond to the low-frequency spectrum modifier 437 of FIG. 4.

The module 1200 shown in FIG. 12 may include a weighting calculator 1210, a weighting predictor 1230, a whitening unit 1250, a random noise generator 1270, and a weighting application unit 1290. The components may be implemented by respective processors or integrated into at least one processor. Since a low-frequency excitation spectrum may be modified instead of a low-frequency spectrum, the low-frequency excitation spectrum and the low-frequency spectrum will be mixedly used without discrimination hereinafter.

Referring to FIG. 12, the weighting calculator 1210 may calculate a first weighting of the low-frequency spectrum from a linear prediction error of the low-frequency spectrum. Specifically, a modified low-frequency spectrum may be generated by mixing random noise with a signal obtained by whitening the low-frequency spectrum. In this case, for a mixing ratio, a second weighting of a high-frequency spectrum is applied, and the second weighting of the high-frequency spectrum may be obtained from the first weighting of the low-frequency spectrum. Herein, the first weighting may be calculated based on signal prediction possibility. Specifically, when the signal prediction possibility increases, a linear prediction error may decrease, and vice versa. That is, when the linear prediction error increases, the first weighting is set to a small value, and as a result, a value (1−W) to be multiplied by the random noise is greater than a value (W) to be multiplied by the low-frequency spectrum, and thus relatively much random noise may be included, thereby generating a modified low-frequency spectrum. Otherwise, when the signal prediction possibility decreases, the first weighting is set to a large value, and as a result, the value (1−W) to be multiplied by the random noise is less than the value (W) to be multiplied by the low-frequency spectrum, and thus relatively little random noise may be included, thereby generating a modified low-frequency spectrum. Herein, a relationship between the linear prediction error and the first weighting may be mapped in advance through simulations or experiments.

The weighting predictor 1230 may predict the second weighting of the high-frequency spectrum based on the first weighting of the low-frequency spectrum, which is provided from the weighting calculator 1210.

Specifically, when the high-frequency excitation generator 439 of FIG. 4 generates the high-frequency excitation spectrum, a source band as a basis is determined in consideration of a relationship between a source frequency band and a target frequency band, and thereafter when a weighting of the determined source band, i.e., the first weighting of the low-frequency spectrum, is determined, the second weighting of the high-frequency spectrum may be predicted by multiplying the first weighting by a constant set for each class. A predicted second weighting $w_i$ of a high-frequency band i may be defined as calculation for each band using Equation 10.

$$w_i = g_{i,midx} * w_j \tag{10}$$

where $g_{i,midx}$ denotes a constant to be multiplied by the band i determined by a class index midx, and $w_j$ denotes a calculated first weighting of a source band j.

The whitening unit 1250 may whiten the low-frequency spectrum by defining a whitening envelope in consideration of an ambient spectrum for each frequency bin with respect to a frequency-domain signal, i.e., the low-frequency spectrum, and multiplying the low-frequency spectrum by a reciprocal number of the defined whitening envelope. In this case, a range of the considered ambient spectrum may be determined based on the second weight of the high-frequency spectrum, which is provided from the weight predictor 1230. Specifically, the range of the considered ambient spectrum may be determined based on a window obtained by multiplying a size of a basic window by the second weighting, and the second weighting may be obtained from a corresponding target band based on a mapping relationship between a source band and a target band. A rectangular window may be used as the basic window, but the basic window is not limited thereto. The whitening may be performed by obtaining energy within the determined window and scaling a low-frequency spectrum corresponding to a frequency bin based on a square root of the energy.

The random noise generator 1270 may generate random noise by various well-known methods.

The weighting application unit 1290 may receive the whitened low-frequency spectrum and the random noise and mix the whitened low-frequency spectrum and the random noise by applying the second weighting of the high-frequency spectrum, thereby generating a modified low-frequency spectrum. As a result, the weight application unit 1290 may provide the modified low-frequency spectrum to the envelope application unit 443.

Figure 13:
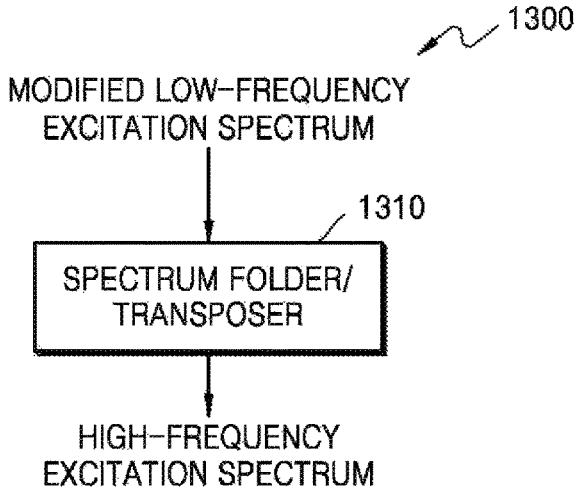
FIG. 13 is a block diagram of a high-frequency excitation generation module according to an exemplary embodiment.

FIG. 13 is a block diagram of a high-frequency excitation generation module 1300 according to an exemplary embodiment, and may correspond to the high-frequency excitation generator 439 of FIG. 4.

The module 1300 shown in FIG. 13 may include a spectrum folder/transposer 1310.

Referring to FIG. 13, the spectrum folder/transposer 1310 may generate a spectrum in a high-frequency band by using a modified low-frequency excitation spectrum. A modified low-frequency spectrum may be used instead of the modified low-frequency excitation spectrum. The modified low-frequency excitation spectrum may be transposed or folded and moved to a specific location of the high-frequency band.

Figure 14:
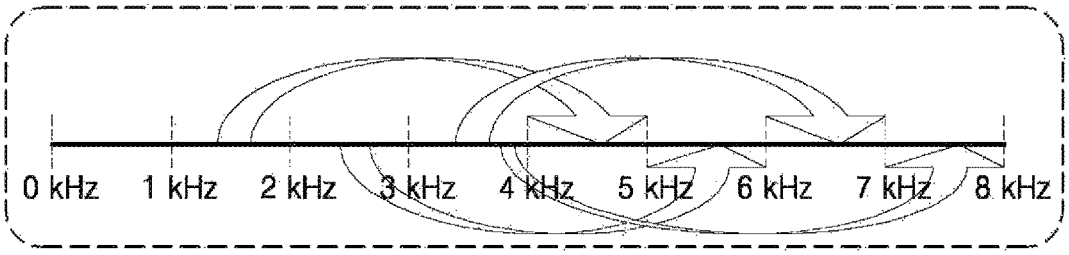
FIG. 14 illustrates transposing and folding.

According to an example of transposing and folding, which is shown in FIG. 14, a 4- to 7-KHz band may be generated by transposing a spectrum in a 1- to 4-KHz band, and a 7- to 8-KHz band may be generated by folding a spectrum in a 3- to 4-KHz band.

Figure 15:
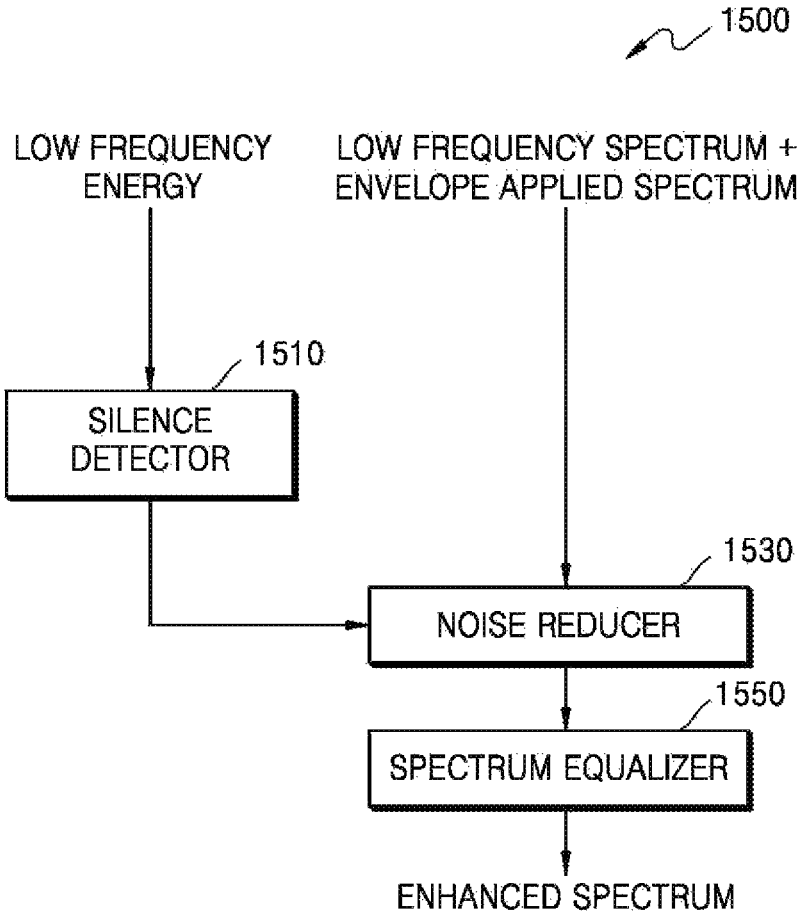
FIG. 15 is a block diagram of an equalization module according to an exemplary embodiment.

FIG. 15 is a block diagram of an equalization module 1500 according to an exemplary embodiment.

The module 1500 shown in FIG. 15 may include a silence detector 1510, a noise reducer 1530, and a spectrum equalizer 1550. The components may be implemented by respective processors or integrated into at least one processor.

Referring to FIG. 15, the silence detector 1510 may detect a current sub-frame as a silence period when a case where low-frequency energy in the current sub-frame is less than a predetermined threshold is repeated several times. Herein, the threshold and the number of repetitions may be set in advance through simulations or experiments.

The noise reducer 1530 may reduce noise occurring in the silence period by gradually reducing a size of a high-frequency spectrum of the current sub-frame when the current sub-frame is detected as the silence period. To this end, the noise reducer 1530 may apply a noise reduction gain on a sub-frame basis. When a signal of a full band including a low frequency and a high frequency is gradually reduced, the noise reduction gain may be set to converge to a value close to 0. In addition, when a sub-frame in the silence period is changed to a sub-frame in a non-silence period, a magnitude of a signal is gradually increased, and in this case, the noise reduction gain may be set to converge to 1. The noise reducer 1530 may set a rate of the noise reduction gain for gradual reduction to be less than that of the noise reduction gain for gradual increase, such that reduction is slowly achieved, whereas the increase is quickly achieved. Herein, the rate may indicate a magnitude of an increase portion or a reduction portion for each sub-frame when a gain is gradually increased or reduced for each sub-frame. The silence detector 1510 and the noise reducer 1530 may be selectively applied.

The spectrum equalizer 1550 may change a noise-reduced signal provided from the noise reducer 1530 to a speech relatively preferred by a user by applying a different equalizer gain for each frequency band or sub-band to the noise-reduced signal provided from the noise reducer 1530. Alternatively, the same equalizer gain may be applied to specific frequency bands or sub-bands. The spectrum equalizer 1550 may apply the same equalizer gain to all signals, i.e., a full frequency band. Alternatively, an equalizer gain for a voiced speech and an equalizer gain for a unvoiced speech may be differently set, and the two equalizer gains may be mixed by a weighted sum based on a voicing level of a current sub-frame and applied. As a result, the spectrum equalizer 1550 may provide a spectrum of which speech quality has been enhanced and from which noise has been cancelled to the inverse transformer (447 of FIG. 4).

Figure 16:
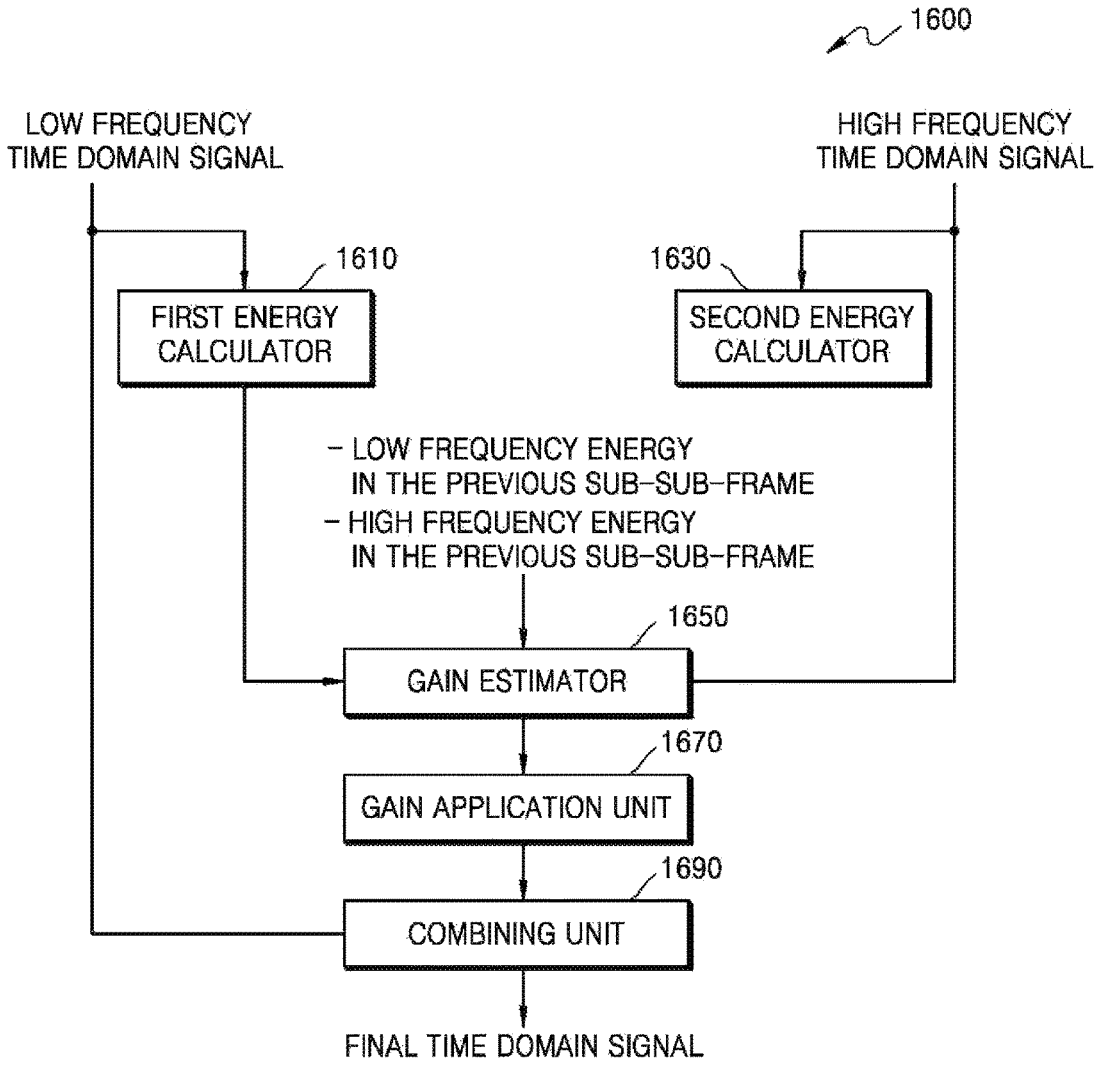
FIG. 16 is a block diagram of a time-domain post-processing module according to an exemplary embodiment.

FIG. 16 is a block diagram of a time-domain post-processing module 1600 according to an exemplary embodiment, and may correspond to the time-domain post-processor 449 of FIG. 4.

The module 1600 shown in FIG. 16 may include a first energy calculator 1610, a second energy calculator 1630, a gain estimator 1650, a gain application unit 1670, and a combining unit 1690. The components may be implemented by respective processors or integrated into at least one processor. Each component of the time-domain post-processing module 1600 may operate in a smaller unit than each component of the apparatus 400 for enhancing speech quality, which is shown in FIG. 4. For example, when the whole components of FIG. 4 operate on a sub-frame basis, each component of the time-domain post-processing module 1600 may operate on a sub-sub-frame basis.

Referring to FIG. 16, the first energy calculator 1610 may calculate low-frequency energy from a low-frequency time-domain signal on a sub-sub-frame basis.

The second energy calculator 1630 may calculate high-frequency energy from a high-frequency time-domain signal on a sub-sub-frame basis.

The gain estimator 1650 may estimate a gain to be applied to a current sub-sub-frame to match a ratio between the current sub-sub-frame and a previous sub-sub-frame in the high-frequency energy with a ratio between the current sub-sub-frame and the previous sub-sub-frame in the low-frequency energy. The estimated gain g(i) may be defined by Equation 11.

$$g(i) = \sqrt{\frac{E_H(i-1)}{E_H(i)} \cdot \frac{E_L(i)}{E_L(i-1)}} \tag{11}$$

where $E_H(i)$ and $E_L(i)$ denote high-frequency energy and low-frequency energy of an $i^{th}$ sub-sub-frame.

To prevent the gain g(i) from having a too large value, a predetermined threshold $g_{th}$ may be used. That is, as in Equation 12 below, when the gain g(i) is greater than the predetermined threshold $g_{th}$, the predetermined threshold $g_{th}$ may be estimated as the gain g(i).

$$g(i) = \min\left(\sqrt{\frac{E_H(i-1)}{E_H(i)} \cdot \frac{E_L(i)}{E_L(i-1)}}, g_{th}\right) \tag{12}$$

The gain application unit 1670 may apply the gain estimated by the gain estimator 1650 to the high-frequency time-domain signal.

The combining unit 1690 may generate a bandwidth-extended time-domain signal, i.e., a wideband time-domain signal, by combining the low-frequency time-domain signal and the gain-applied high-frequency time-domain signal.

Figure 17:
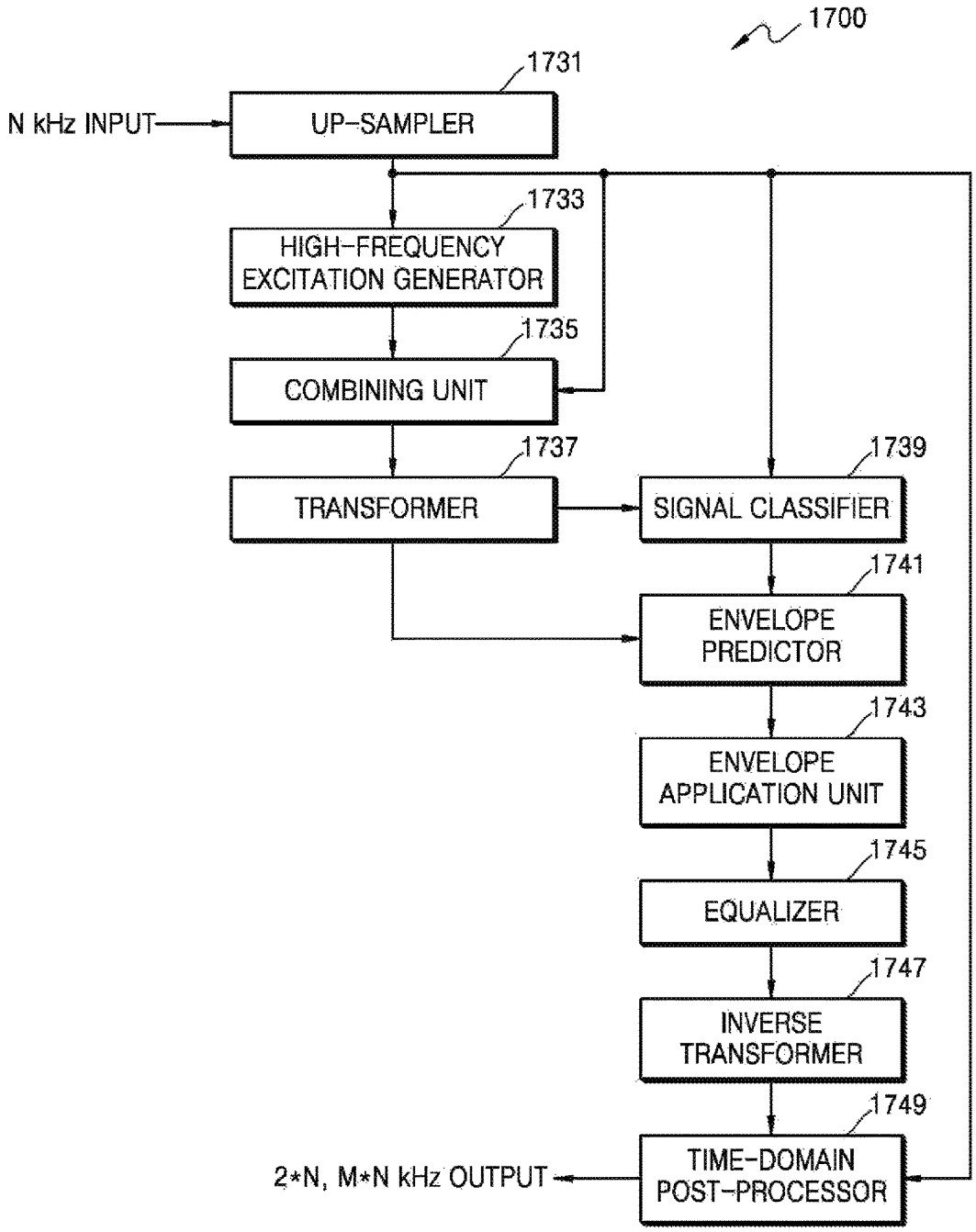
FIG. 17 is a block diagram of an apparatus for enhancing speech quality, according to another exemplary embodiment.

FIG. 17 is a block diagram of an apparatus 1700 for enhancing speech quality, according to another exemplary embodiment, and may correspond to the post-processor 130 or 250 of FIG. 1 or 2. A most difference from the apparatus 400 for enhancing speech quality, which is shown in FIG. 4, may be a location of a high-frequency excitation generator 1733.

The apparatus 1700 shown in FIG. 17 may include an up-sampler 1731, a high-frequency excitation generator 1733, a combining unit 1735, a transformer 1737, a signal classifier 1739, an envelope predictor 1741, an envelope application unit 1743, an equalizer 1745, an inverse transformer 1747, and a time-domain post-processor 1749. The components may be implemented by respective processors or integrated into at least one processor. Operations of the up-sampler 1731, the envelope predictor 1741, the envelope application unit 1743, the equalizer 1745, the inverse transformer 1747, and the time-domain post-processor 1749 are substantially the same as or similar to operations of corresponding components of FIG. 4, and thus a detailed description thereof is omitted.

Referring to FIG. 17, the high-frequency excitation generator 1733 may generate a high-frequency excitation signal by shifting an up-sampled signal, i.e., a low-frequency signal, to a high-frequency band. The high-frequency excitation generator 1733 may generate the high-frequency excitation signal by using a low-frequency excitation signal instead of the low-frequency signal. According to an embodiment, a spectrum shifting scheme may be used. Specifically, the low-frequency signal may be shifted to the high-frequency band through a cosine modulation in the time domain.

The combining unit 1735 may combine a shifted time-domain signal, i.e., the high-frequency excitation signal, provided from the high-frequency excitation generator 1733 and the up-sampled signal, i.e., the low-frequency signal and provide the combined signal to the transformer 1737.

The transformer 1737 may generate a frequency-domain signal by transforming the signal in which a low frequency and a high frequency are combined, which is provided from the combiner 1735. The transform may be MDCT, FFT, MDCT+MDST, QMF, or the like but is not limited thereto.

The signal classifier 1739 may use the low-frequency signal provided from the up-sampler 1731 or the signal in which the low frequency and the high frequency are combined, which is provided from the combiner 1735, to extract a feature of the time domain. The signal classifier 1739 may use a full-band spectrum provided from the transformer 1737 to extract a feature of the frequency domain. In this case, a low-frequency spectrum may be selectively used from the full-band spectrum. The other operation of the signal classifier 1739 may be the same as an operation of the signal classifier 435 of FIG. 4.

The envelope predictor 1741 may predict an envelope of the high frequency by using the low-frequency spectrum as in FIG. 4, and the envelope application unit 1743 may apply the predicted envelope to a high-frequency spectrum as in FIG. 4.

According to the embodiment of FIG. 4, the high-frequency excitation signal may be generated in the frequency domain, and according to the embodiment of FIG. 17, the high-frequency excitation signal may be generated in the time domain. As in FIG. 17, when the high-frequency excitation signal is generated in the time domain, a low-frequency temporal characteristic may be easily reflected to the high frequency. According to this, since a time-domain coding method is generally used for a speech signal mainly included in a call packet, the embodiment of FIG. 17 may be more suitable than the embodiment of FIG. 4. However, as in FIG. 4, when the high-frequency excitation signal is generated in the frequency domain, signal control may be freely performed for each band.

Figure 18:
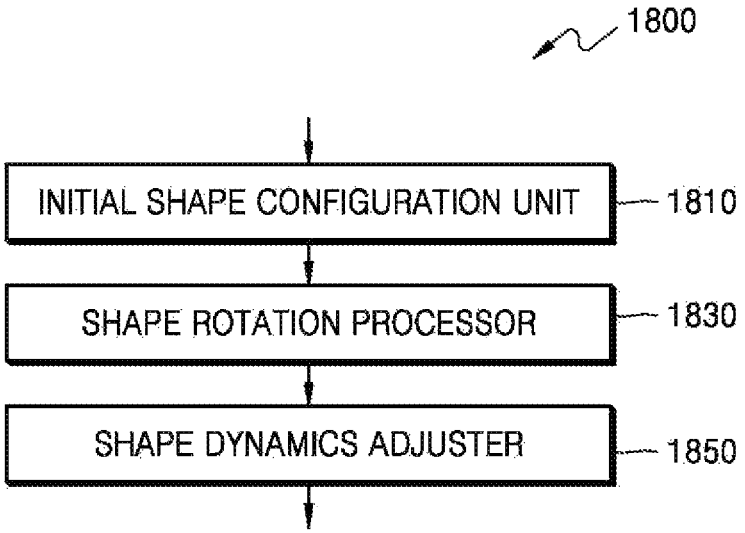
FIG. 18 is a block diagram of the shape predictor shown in FIG. 8.

FIG. 18 is a block diagram of the shape predictor 830 shown in FIG. 8.

A shape predictor 1800 shown in FIG. 18 may include an initial shape configuration unit 1810, a shape rotation processor 1830, and a shape dynamics adjuster 1850.

Referring to FIG. 18, the initial shape configuration unit 1810 may extract envelope information Env(b) from a low frequency and configure an initial shape for a high-frequency shape from the extracted envelope information Env (b). Shape information may be extracted by using a mapping relationship between a low-frequency band and a high-frequency band. To this end, for example, such a mapping relationship that 4 KHz to 4.4 KHz of a high frequency correspond to 1 KHz to 1.4 KHz of the low frequency may be defined. A portion of the low frequency may be repetitively mapped to the high frequency.

The shape rotation processor 1830 may shape-rotate the initial shape. For the shape rotation, a slope may be defined by Equation 13.

$$slp = 2\left(1 - \frac{\frac{1}{N_B}\sum_{b=0}^{N_B-1} Env(b)}{\frac{1}{N_B}\sum_{b=0}^{N_B-1} Env(b) + \frac{1}{N_I}\sum_{b=0}^{N_I-1} Env(b)}\right) \tag{13}$$

where Env denotes an envelope value for each band, $N_I$ denotes a plurality of initial start bands, and $N_B$ denotes a full band.

The shape rotation processor 1830 may extract an envelope value from the initial shape and calculate a slope by using the envelope value, to perform the shape rotation.

The shape rotation may be performed by Equation 14, wherein the rotation may be performed by a rotation factor $\rho=1-slp_{If}$.

$$shp_r(b) = shp_e(b)\cdot\left(\frac{b}{N_B}\cdot(1-\rho)+\rho\right) \tag{14}$$

The shape dynamics adjuster 1850 may adjust dynamics of the rotated shape. The dynamics adjustment may be performed by using Equation 15.

$$shp_d(b) = d\cdot shp_r(b) + (1-d)\cdot\frac{1}{N_B}\sum_i shp_r(i) \tag{15}$$

Herein, a dynamics adjustment factor d may be defined as d=0.5 slp.

As described above, since the rotation is performed while maintaining a shape of the low frequency, a natural tone may be generated. Particularly, with respect to a unvoiced speech, a shape difference between the low frequency and the high frequency may be great, dynamics may be adjusted to solve this.

Figure 19:
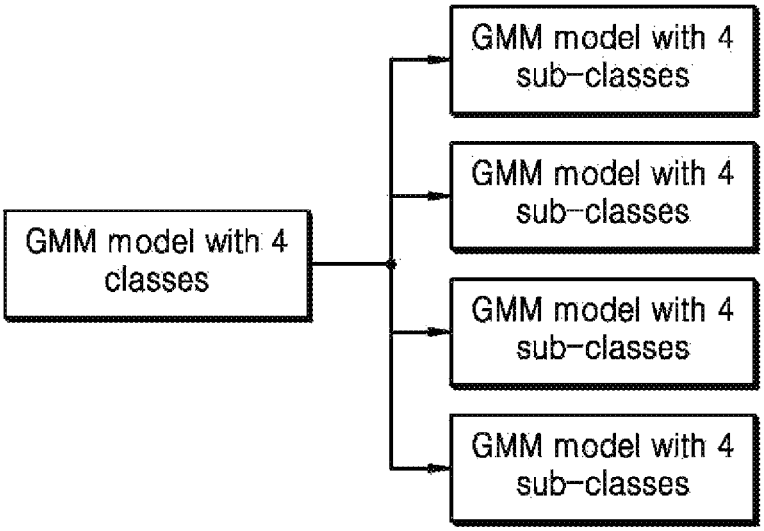
FIG. 19 illustrates an operation of a class determiner shown in FIG. 7.

FIG. 19 illustrates an operation of the class determiner 750 shown in FIG. 7.

Referring to FIG. 19, a class may be determined by using a plurality of stages. For example, in a first stage, four classes may be identified by using slope information, and in a second stage, each of the four classes may be classified into four sub-classes by using an additional feature. That is, 16 sub-classes may be determined and may have the same meaning as the class defined by the class determiner 750. In the first and second stages, the GMM is used as a feature, and in the second stage, a gradient index, a centroid, and an energy quotient may be used as features. A detained description thereof is disclosed in the document "Artificial bandwidth extension of narrowband speech—enhanced speech quality and intelligibility in mobile" (L. Laaksonen, doctoral dissertation, Aalto University, 2013).

Figure 20:
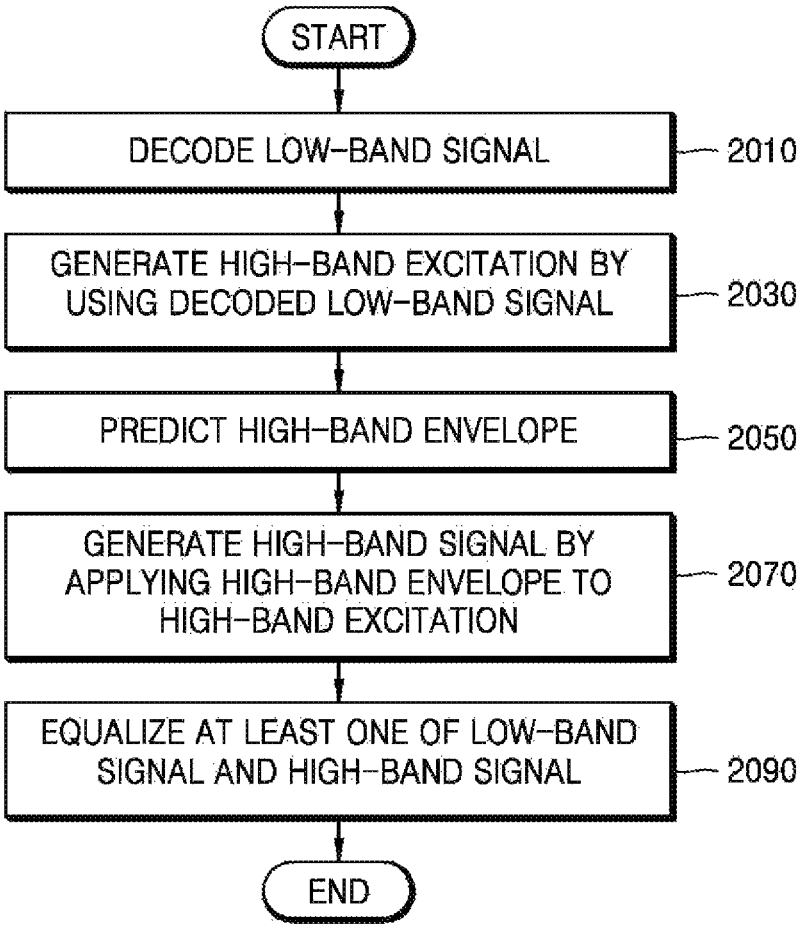
FIG. 20 is a flowchart describing a method of enhancing speech quality, according to an exemplary embodiment.

FIG. 20 is a flowchart describing a method of enhancing speech quality, according to an exemplary embodiment, wherein a corresponding operation may be performed by a component of each apparatus described above or a separate processor.

Referring to FIG. 20, in operation 2010, a speech signal may be decoded by using a codec embedded in a receiver. Herein, the decoded speech signal may be a narrowband signal, i.e., a low-band signal.

In operation 2030, a high-band excitation signal or a high-band excitation spectrum may be generated by using the decoded low-band signal. Herein, the high-band excitation signal may be generated from a narrowband time-domain signal. In addition, the high-band excitation spectrum may be generated from a modified low-band spectrum.

In operation 2050, an envelope of the high-band excitation spectrum may be predicted from the low-band spectrum based on a class of the decoded speech signal. Herein, each class may indicate a mute speech, background noise, a weak speech signal, a voiced speech, or a unvoiced speech but is not limited thereto.

In operation 2070, a high-band spectrum may be generated by applying the predicted envelope to the high-band excitation spectrum.

In operation 2090, at least one of the low-band signal and the high-band signal may be equalized. According to an embodiment, only the high-band signal may be equalized, or a full band may be equalized.

A wideband signal may be obtained by synthesizing the low-band signal and the high-band signal. Herein, the low-band signal may be the decoded speech signal or a signal which has been equalized and then transformed into the time domain. The high-band signal may be a signal to which the predicted envelope has been applied and then which has been transformed into the time domain or a signal which has been equalized and then transformed into the time domain.

In the embodiments, since a frequency-domain signal may be separated for each frequency band, a low-frequency band or a high-frequency band may be separated from a full-band spectrum and used to predict an envelope or apply an envelope according to circumstances.

One or more embodiments may be implemented in a form of a recording medium including computer-executable instructions such as a program module executed by a computer system. A non-transitory computer-readable medium may be an arbitrary available medium which may be accessed by a computer system and includes all types of volatile and nonvolatile media and separated and non-separated media. In addition, the non-transitory computer-readable medium may include all types of computer storage media and communication media. The computer storage media include all types of volatile and nonvolatile and separated and non-separated media implemented by an arbitrary method or technique for storing information such as computer-readable instructions, a data structure, a program module, or other data. The communication media typically include computer-readable instructions, a data structure, a program module, other data of a modulated signal such as a carrier, other transmission mechanism, and arbitrary information delivery media.

In addition, in the [resent disclosure, the term such as " . . . unit" or " . . . module" may indicate a hardware component such as a circuit and/or a software component executed by a hardware component such as a circuit.

The embodiments described above are only illustrative, and it will be understood by those of ordinary skill in the art that various changes in form and details may be made therein without changing the technical spirit and mandatory features of the present disclosure. Therefore, the embodiments should be understood in the illustrative sense only and not for the purpose of limitation in all aspects. For example, each component described as a single type may be carried out by being distributed, and likewise, components described as a distributed type may also be carried out by being coupled.

The scope of the present disclosure is defined not by the detailed description but by the appended claims, and all changed or modified forms derived from the meaning and scope of the claims and their equivalent concept will be construed as being included in the scope of the present disclosure.

The invention claimed is:

1. A method of enhancing speech quality in a decoding apparatus, the method comprising:

generating a high-frequency signal by using a low-frequency signal in a time domain;

combining the low-frequency signal with the high-frequency signal;

transforming the combined signal into a spectrum in a frequency domain;

classifying, performed by a class determiner implemented by at least one processor, the low-frequency signal based on a plurality of signal characteristics;

predicting, performed by an envelope predictor implemented by said at least one processor, an envelope from a low-frequency spectrum obtained in the transforming, based on a result of the classifying; and generating a final high-frequency spectrum by applying the predicted envelope to a high-frequency spectrum obtained in the transforming, wherein the predicting comprises:

predicting an energy from the low-frequency spectrum, based on the result of the classifying;

predicting a shape from the low-frequency spectrum, based on the result of the classifying; and obtaining the envelope by using the energy and the shape.

2. The method of claim 1, wherein each operation is performed on a sub-frame basis.

3. The method of claim 1, wherein the predicting of the energy comprises applying a limiter to the predicted energy.

4. The method of claim 1, wherein the predicting of the shape comprises predicting each of a voiced shape and a unvoiced shape and predicting the shape from the voiced shape and the unvoiced shape based on the result of the classifying.

5. The method of claim 1, wherein the predicting of the shape comprises:

configuring an initial shape for the high-frequency spectrum from the low-frequency spectrum; and shape-rotating the initial shape.

6. The method of claim 5, wherein the predicting of the shape further comprises adjusting dynamics of the shape-rotated initial shape.

7. The method of claim 1, further comprising equalizing at least one of the low-frequency spectrum and the high-frequency spectrum.

8. The method of claim 1, further comprising:

equalizing at least one of the low-frequency spectrum and the high-frequency spectrum;

inverse-transforming the equalized at least one of the low-frequency spectrum and the high-frequency spectrum into a signal in the time domain; and post-processing the signal transformed into the time domain.

9. The method of claim 8, wherein the equalizing and the inverse-transforming into the time domain are performed on a sub-frame basis, and the post-processing is performed on a sub-sub-frame basis.

10. The method of claim 8, wherein the post-processing comprises:

calculating low-frequency energy and high-frequency energy;

estimating a gain for matching the low-frequency energy and the high-frequency energy; and applying the estimated gain to a high-frequency time-domain signal.

11. The method of claim 10, wherein the estimating of the gain comprises limiting the estimated gain to a predetermined threshold if the estimated gain is greater than the predetermined threshold.

12. A method of enhancing speech quality in a decoding apparatus, the method comprising:

transforming a low-frequency signal into a spectrum in a frequency domain;

classifying, performed by a class determiner implemented by at least one processor, the low-frequency signal based on a plurality of signal characteristics;

predicting, performed by an envelope predictor module implemented by said at least one processor, an envelope from a low-frequency spectrum obtained in the transforming, based on a result of the classifying;

generating a modified low-frequency spectrum by mixing the low-frequency spectrum and random noise based on the result of the classifying; and generating a high-frequency spectrum by applying the predicted envelope to a high-frequency excitation spectrum generated from the modified low-frequency spectrum, wherein the predicting comprises:

predicting an energy from the low-frequency spectrum, based on the result of the classifying;

predicting a shape from the low-frequency spectrum, based on the result of the classifying; and obtaining the envelope by using the energy and the shape.

13. The method of claim 12, wherein the generating of the modified low-frequency spectrum comprises:

determining a first weighting based on a prediction error;

predicting a second weighting based on the first weighting and the result of the classifying;

whitening the low-frequency spectrum based on the second weighting; and generating the modified low-frequency spectrum by mixing the whitened low-frequency spectrum and random noise based on the second weighting.

14. The method of claim 12, wherein the predicting of the energy comprises applying a limiter to the predicted energy.

15. The method of claim 12, wherein the predicting of the shape comprises predicting each of a voiced shape and a unvoiced shape and predicting the shape from the voiced shape and the unvoiced shape based on the result of the classifying.

16. The method of claim 12, wherein the predicting of the shape comprises:

configuring an initial shape for the high-frequency spectrum from the low-frequency spectrum; and shape-rotating the initial shape.

17. The method of claim 16, wherein the predicting of the shape further comprises adjusting dynamics of the shape-rotated initial shape.

* * * * *